US005725096A

United States Patent [19]

Winnard

[11] Patent Number: 5,725,096

[45] Date of Patent: Mar. 10, 1998

[54] MAGNETIC SYSTEM OF TOOL MANAGEMENT

[76] Inventor: Stanley Winnard, 2528 Clearspring Dr. North, Irving, Tex. 75063

[21] Appl. No.: 439,997

[22] Filed: May 12, 1995

Related U.S. Application Data

[63] Continuation-in-part of Ser. No. 318,912, Oct. 5, 1994.

[51] Int. Cl.[6] ..... A45C 11/26

[52] U.S. Cl. ..... 206/350; 206/377; 206/378; 206/818; 211/DIG. 1

[58] Field of Search ..... 206/350, 376, 206/377, 378, 486, 490, 818; 211/70.6, DIG. 1; 451/494; 269/8; 29/810

[56] References Cited

U.S. PATENT DOCUMENTS

| | | | |
|---|---|---|---|
| 3,405,377 | 10/1968 | Pierce | 206/378 |
| 3,842,980 | 10/1974 | Kushner | 211/DIG. 1 |
| 4,421,230 | 12/1983 | Stanton | 206/378 |
| 4,457,425 | 7/1984 | Cooper et al. | 206/350 |
| 4,736,843 | 4/1988 | Leonard | 206/372 |
| 4,928,821 | 5/1990 | Belko, Jr. | 206/490 |
| 5,080,230 | 1/1992 | Winnard | 206/378 |
| 5,081,798 | 1/1992 | Clasen | 206/494 |
| 5,320,223 | 6/1994 | Allen | 206/459.5 |
| 5,344,012 | 9/1994 | Matthews | 206/818 |
| 5,409,560 | 4/1995 | Hammer et al. | 206/373 |
| 5,511,662 | 4/1996 | Amoroso et al. | 206/376 |
| 5,560,480 | 10/1996 | Singleton | 206/378 |

*Primary Examiner*—David T. Fidei
*Attorney, Agent, or Firm*—Michael, Best & Friedrich

[57] ABSTRACT

A magnetic tool management system with a magnetically attracting material having a number of spaced apart apertures of a size and shape for accommodating at least one surface of a tool. The magnetically attracting member optionally has indicia disposed thereon describing a tool corresponding to at least one of the apertures. The apertures are generally organized in a substantially planar array. The array includes substantially circular apertures which hold sockets in a variant. Optionally, an overlay is applied to the magnetically attracting member. The overlay has optional indicia thereon describing a tool corresponding to at least one of the respective apertures. The tool management system further includes a plurality of sockets disposed within the substantially circular apertures, and is used in a tool box having at least one accessible compartment. The tool box has tools, or portions thereof, such as sockets disposed in the apertures of the tool management system.

28 Claims, 9 Drawing Sheets

MAGNETIC SYSTEM OF TOOL MANAGEMENT

CROSS-REFERENCE TO RELATED APPLICATIONS (Claiming Benefit Under 35 USC 119 and 120)

This application is a continuation-in-part application of pending U.S. application Ser. No. 08/318,912 entitled "Magnetic Tool Organizers, and Tool Box with Magnetic Tool Organizers," filed Oct. 5, 1994 by Mr. Stanley Winnard.

BACKGROUND OF THE INVENTION

This invention relates to tool management systems; and, more particularly, it relates to magnetic tool management systems for use in the organization and storage of tools. Recently, there has been a growing trend in the use of tool management systems among homeowners, and do-it-yourselfer's for storing and organizing various hand tools. In addition to non-professionals, professional mechanics in both the industrial and automotive markets, and indeed in all areas of industry, have a need for storing and organizing their tools, and components of machinery that are assembled and disassembled.

The rapid storage and retrieval of a particular tool during a project, is a very desirable goal. However, this goal is not easily achieved. Devices created to assist in the rapid retrieval of tools include tool management systems, and tool management systems used in combination with tool boxes.

Traditional tool management systems are large and bulky, and traditional tool box compartments only offer a limited amount of vertical clearance for the storage of tools. Hence, there exists a need for a tool management and inventory system that can store, organize and retain a tool and fit easily into the limited vertical and horizontal space constraints of a tool box compartment.

Generally known tool management systems are made from foam, and include tool box compartment drawer liners. These drawer liners are expensive to produce as each drawer liner must be designed and die cut to meet specific tool compartment sizes. In fact, the manufacture of a set of foam drawer liners can require tens of hours of manual labor at great cost. There exists a need for a tool management and inventory system that reduces tool losses, promotes productivity and brings tool investment costs in line with operations, and has reduced production costs.

Known tool management systems have the additional problem in that tools can be knocked out of compartments in which the systems rest or knocked out of order. Tool management system formed from foam rely on a friction fit between the tool and the liner. Over time, as tools are removed and inserted into the drawer liner repeatedly, openings in the drawer liner become worn and hence reduce the friction fit between the tool and the liner. There exists a need for a tool management system that does not rely on a friction fit for the storage and retention of tools, and provides retention of tools after repeated wear.

Professional mechanics, and in particular, airline mechanics, also have a need for storing and organizing tools and engine components for assembly or after disassembly. An airline mechanic must ensure that all parts that have been disassembled from an engine are placed back into the engine. Moreover, an airline mechanic must ensure that he has not accidentally left a tool in an engine compartment. An omitted engine component or accidentally placed tool in an engine compartment can have catastrophic consequences since the operation of an engine can be disrupted. Hence, there exists a need for tool management system that can help inventory engine parts and tools, reduces the risk of a tool being left in an engine compartment, and is of low cost to manufacture and produce.

SUMMARY OF THE INVENTION

The present invention provides a magnetic tool management system with a magnetically attracting member having a plurality of spaced apart apertures of a size and shape for accommodating at least one surface of a tool or portion thereof. The magnetically attracting member optionally has indicia disposed thereon describing a tool or portion thereof corresponding to at least one of the apertures. The apertures are generally organized in a substantially planar array. The array includes substantially circular apertures which hold sockets in a variant. At least one row of apertures is provided that has aperture diameters of descending diameter in a preferred embodiment.

Optionally, an overlay is applied to the magnetically attracting member. The overlay has optional indicia thereon describing a tool or portion thereof corresponding to at least one of the respective apertures. The overlay comprises a coating selected from the group consisting of flexible hydrocarbon resistant coatings, polymeric coatings, coatings that shield the magnetic flux lines of the magnetically attracting member, laminates, and foams. In a variant, the inside surface of the apertures is free of overlay. In yet another variant, the overlay is applied to both top, bottom and side surfaces of the magnetically attracting member. Moreover, the overlay is a commercially available polymeric dip used to coat hand tools and portions thereof.

The tool management system further includes a plurality of sockets disposed within the substantially circular apertures, and is used in a tool box having at least one accessible compartment. Tools, or portions thereof including sockets, are disposed in the apertures of the tool management system and rest on a magnetically attracted surface of the tool box. The tool management systems are also disposed within a plurality of accessible compartments within the tool box, on an outside surface of the tool box, or combination thereof.

The objects and features of the present invention, other than those specifically set forth above, will become apparent in the detailed description of the invention set forth below.

DETAILED DESCRIPTION OF THE INVENTION

Figure 1:
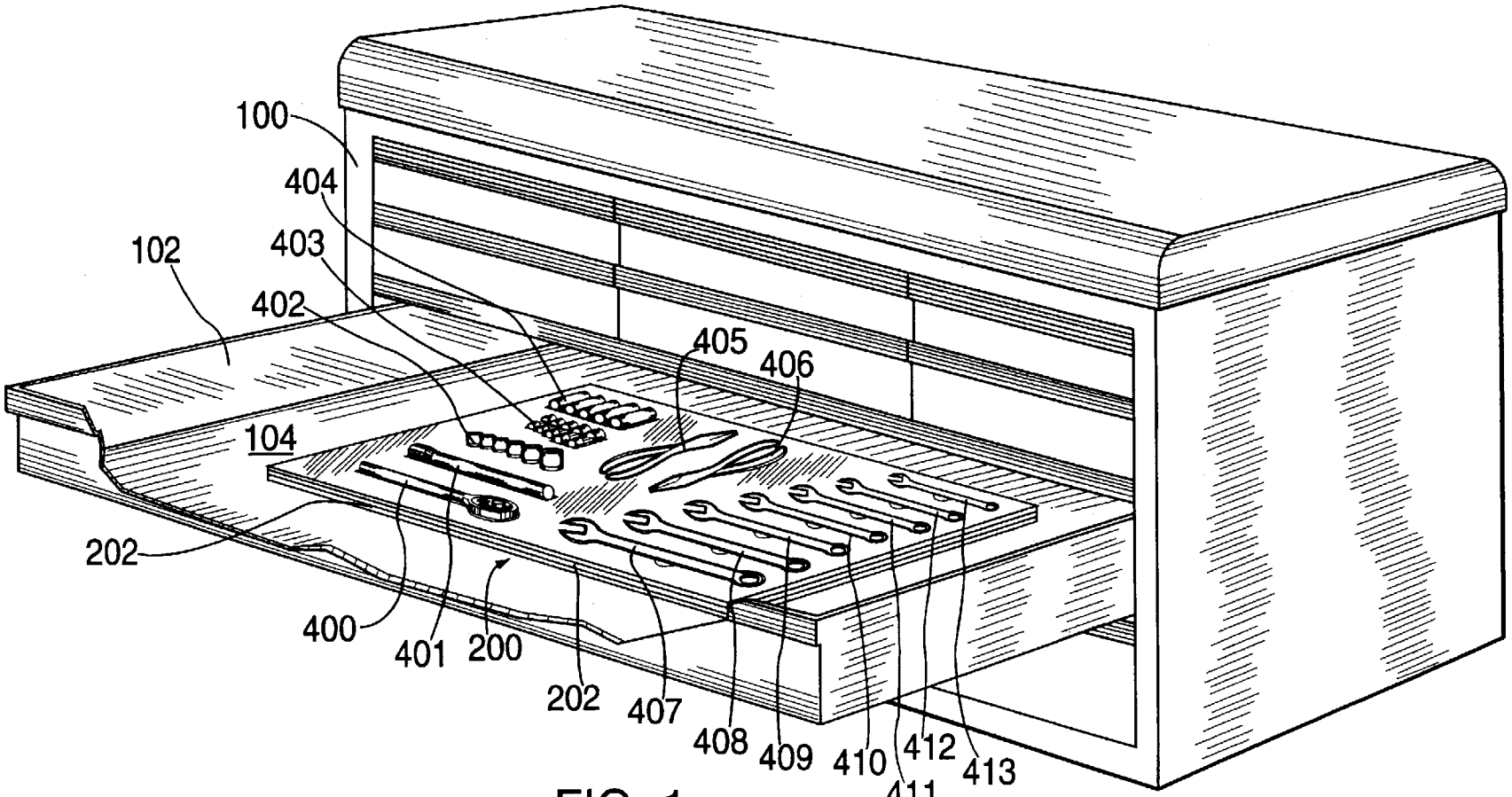
FIG. 1 is a perspective view of a tool box with a magnetic tool management system disposed within a compartment of the tool box.
Figure 2:
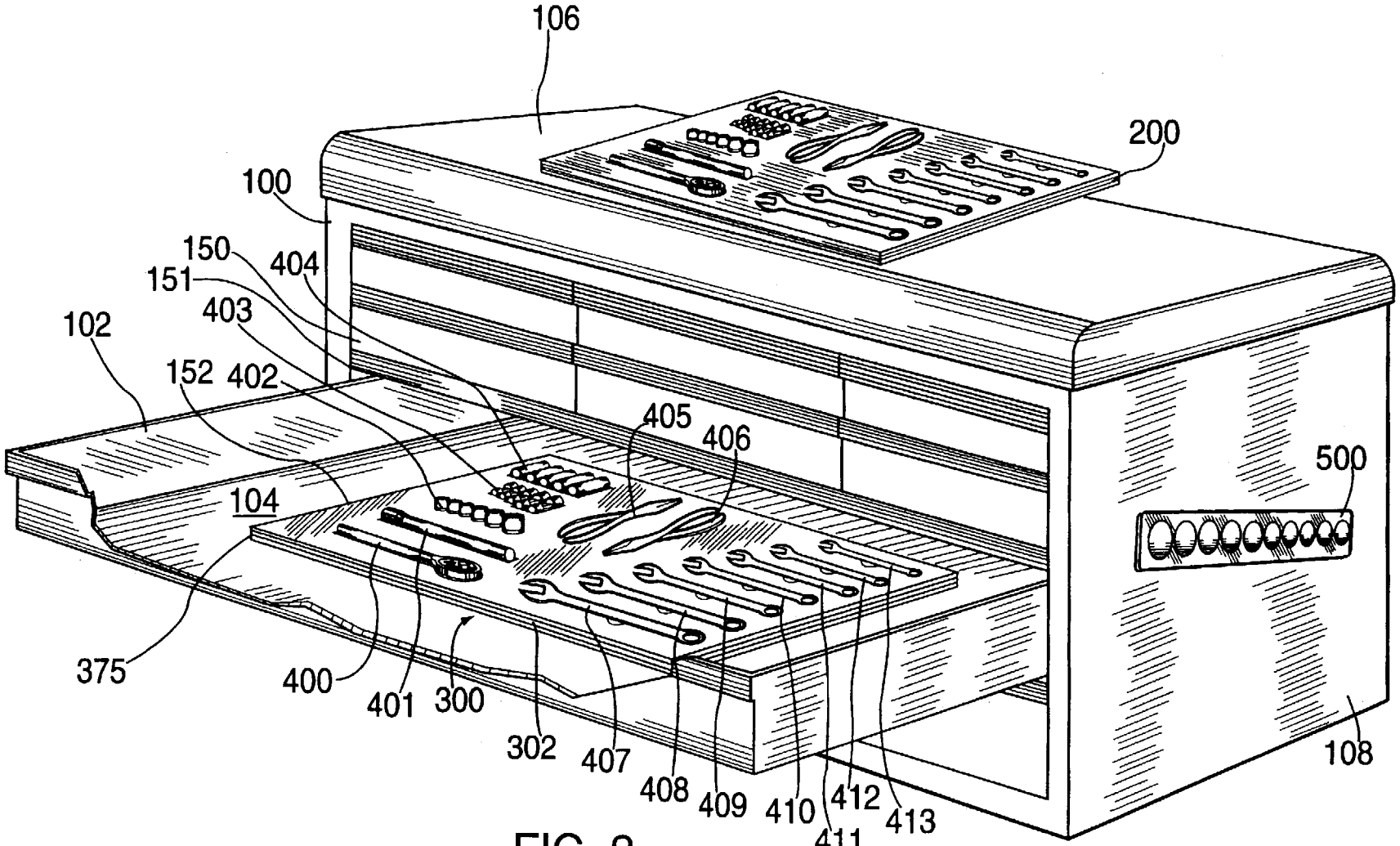
FIG. 2 is a perspective view of a tool box with a magnetic tool management system disposed within a compartment of the tool box and on an exterior surface of the tool box, and also a magnetic tool holder disposed on the side of the tool box.
Figure 8:
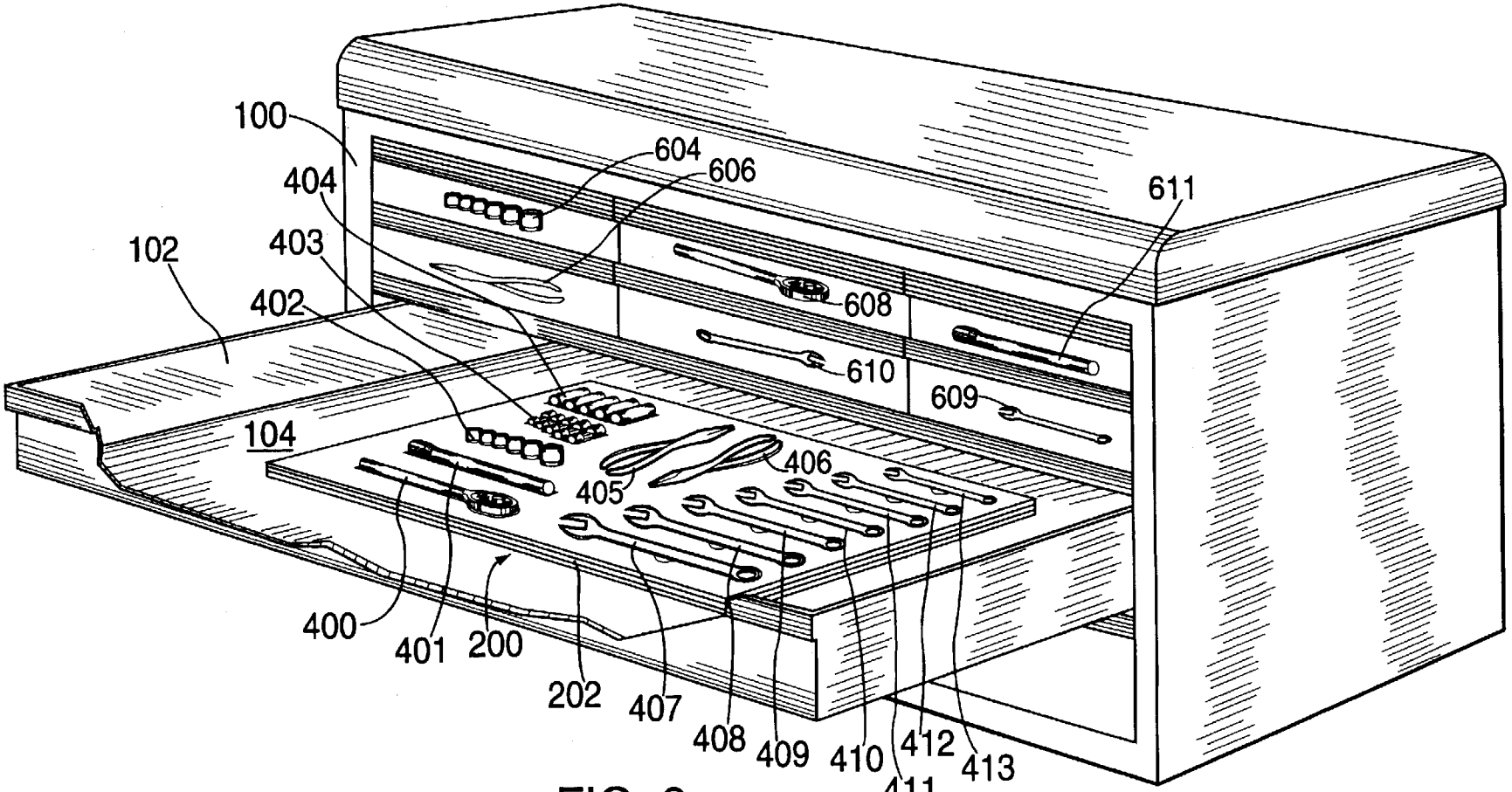
FIG. 8 is a perspective view of a tool box of FIG. 1 with a plurality of magnetic tool silhouettes disposed on the exterior of compartments of the tool box to assist in the location of tools disposed within the tool box compartment drawers.

FIG. 1 is a perspective view of tool box 100 with a magnetic tool management and inventory system 200 disposed within tool box compartment 102 (FIGS. 1, 2, and 8). Magnetic tool management systems 200 (FIGS. 1, 2, 4, 7, and 8), 300 (FIGS. 2, 3, and 6) are disposed within a storage volume 104 (FIGS. 1, 2 and 8) defined by compartment 102 of tool box 100. Optionally, systems 200, 300 are stacked vertically one on top of another as building blocks so as to store a set of tools. In yet another variant, individual systems 200, 300 are combined horizontally in an array for the storage of different tools. Each respective magnetic tool management system 200, 300 has tools 400–413 (FIGS. 1–4, and 8) disposed thereon. In a preferred embodiment, tool box compartment 102 is slidingly disposed in tool box 100. FIG. 2 is a perspective view of compartment 102 of tool box 100 with magnetic tool management system 300 disposed in compartment 102, magnetic tool management system 200 disposed on the lid 106 of tool box 100, and magnetic tool holder 500 (FIGS. 2, 11 and 12) disposed on side wall 108 of tool box 100. The tool management systems 200, 300 organize the contents of large and small tool boxes, tool carts, tool cases, wall mounted tool displays, tool trucks, tool cabinets, lockers, tool boards, and also the interior and exterior walls and floors of service vehicles.

Tool management systems 200, 300 have a variety of tools disposed thereon. For example, magnetic tool management systems 200 (FIGS. 1, 2, 4, 7, and 8), 300 (FIGS. 2, 3, and 6) have exemplary tools, and portions thereof, including socket wrench 400, extensions 401, sockets 402, pliers 405, 406, and wrenches 407–413 disposed thereon. Other hand tools and power tools are also utilized with magnetic tool management systems 200, 300. Exemplary hand tools include hammers, screw drivers, pliers, picks, measuring tapes, rulers, files, drill bits, and router bits. Exemplary power tools include drills, saws, reciprocal saws, planers, and screwdrivers. Optionally, systems 200, 300 and tool organizers and inventory control systems described herein are also used to organize other magnetically attracted components. Exemplary, magnetically attracted components include bolts, nuts, engine parts, screws, hardware, and surgical instruments. It will be appreciated that components having magnetically attracted portions thereof can be used with the systems described herein.

Systems of tool management 200, 300 are optionally placed on a magnetically attracted surface (FIGS. 1, 2, and 8). A magnetically attracted surface is side surface 108 of tool box 100 as in FIG. 2, or a surface of compartment 102 (FIGS. 1 and 2), e.g. a floor of a tool box compartment. In a variant tools 400–413 are nestled in their respective apertures such that a portion of tools 400–413 contacts the magnetically attracted surface of the tool box while another portion protrudes above an upper edge of systems 200, 300. It is appreciated that this nestling allows for lines of magnetic flux to be concentrated at the contact points of the tool, upper member 516 (FIGS. 11 and 12), a magnetically attracted surface, e.g. surface 108, member 200, 300, 516, or combination thereof, and provides for increased holding power over having the tool simply rest on top of a magnet. Generally, where there is a gap between magnetically attracted members the magnetic holding force is reduced. The area of reduced holding power is where the lines of flux are shorted from pole to pole.

Figure 15:
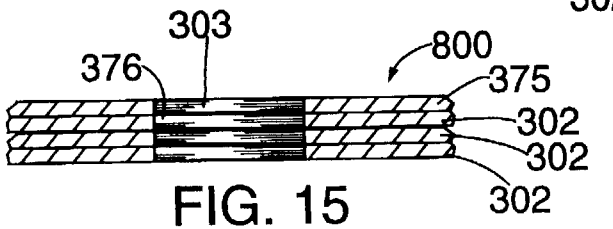
FIG. 15 is side non-exploded cross-sectional view of a magnetic tool management system having magnetic members vertically stacked on top of another.

Systems of tool management (FIGS. 1, 2, 4, 7, and 8), 300 (FIGS. 2, 3, 5 and 6), also known as tool organizers and tool holders, comprise magnetically attracting members 202 (FIGS. 1, 4 and 8), 302 (FIGS. 2, 3, 5 and 6). Magnetically attracting member 202 is comprised of material similar to magnetically attracting member 302, and magnetically attracting member 502 (FIGS. 11 and 12), magnetic silhouette sheet 602 (FIG. 13), and magnetic silhouettes 604 (FIG. 8), 606 (FIGS. 8 and 13), 608 (FIG. 8), 609–611 (FIGS. 8 and 13), 162–615 (FIG. 13). Members 202, 302 are constructed from a flexible strip material formed from non-metallic binding material with magnetic material embedded therein available from Bunting Magnetic Co., Elkgrove Village, Ill. in one embodiment. A type of flexible strip material available from Bunting Magnetic Co. is Type W which as equal magnetic holding strength on both sides of the material. Alternately, a suitable powdered metallic material such as iron oxide, can be mixed with rubber while it is in liquid form. In a conventional manner, this metallic material can be magnetized subsequent to the molding of the material. Members 202, 302, 502, and sheet 602 comprise a NITRILE Rubber Binder having embedded therein strips or rows of magnetic particles in one embodiment. This material is commercially available from 3M Corporation. Other commercial vendors of magnetically attracting material suitable for use in the present invention include Magnetic Specialty, Inc. or Marietta, Ohio, and Arnold Engineering Company of Norfolk, New England manufacturer of PLASTIFORM® brand bonded magnet material. Preferably, members 202, 302, 502, and sheet 602 comprise plastiform flexible permanent magnet material B1030, B1012, B1033, B1037, B1060 (polyamide binder), and magnet material having a nylon binder commercially available from Arnold Engineer Company. Further, members 202, 302, 502, and sheet 602 can be magnetized with one or more poles per side, magnetized conventionally, in patterns that meet with applicable needs, or combination thereof. As illustrated in FIG. 15, where needed members 302 are optionally vertically stacked on top of another. There may be two, three or more members 302 stacked one on top of another to provide for additional depth of aperture 303. The additional depth is used to magnetically retain tools having dimensions that require additional depth for proper retention. The members 302 are held together by magnetic forces, adhesives, by mechanical means such as screws, other types of fasteners, or a combination thereof.

Magnetic members 202, 302, 502, sheet 602 and magnetic silhouettes 604 (FIG. 8), 606 (FIGS. 8 and 13), 608 (FIG. 8), 609–611 (FIGS. 8 and 13), 162–615 (FIG. 13) are multi-pole magnets in one variant. The members may have 2, 4, 6, etc. poles per inch. In a variant, the magnetic members and silhouettes are standard magnets. Further, members 202, 302, 502, and page 602 comprise a single magnet in one variant, or a plurality of magnets that have optional apertures thereon in another variant.

Members 202 (FIGS. 1 and 8), 302 (FIGS. 2, 3, and 5), 502 (FIGS. 11 and 12), silhouette sheet 602 (FIG. 13) have a plurality of spaced apart apertures 303–360 (FIG. 5), 503 (FIGS. 11 and 12), 504–516 (FIG. 11) of a size and shape for accommodating at least one surface of a tool, e.g. tools and portions thereof 400–413. Optionally, the apertures 303–360 are organized in a planar array or a substantially planar array.

Figure 11:
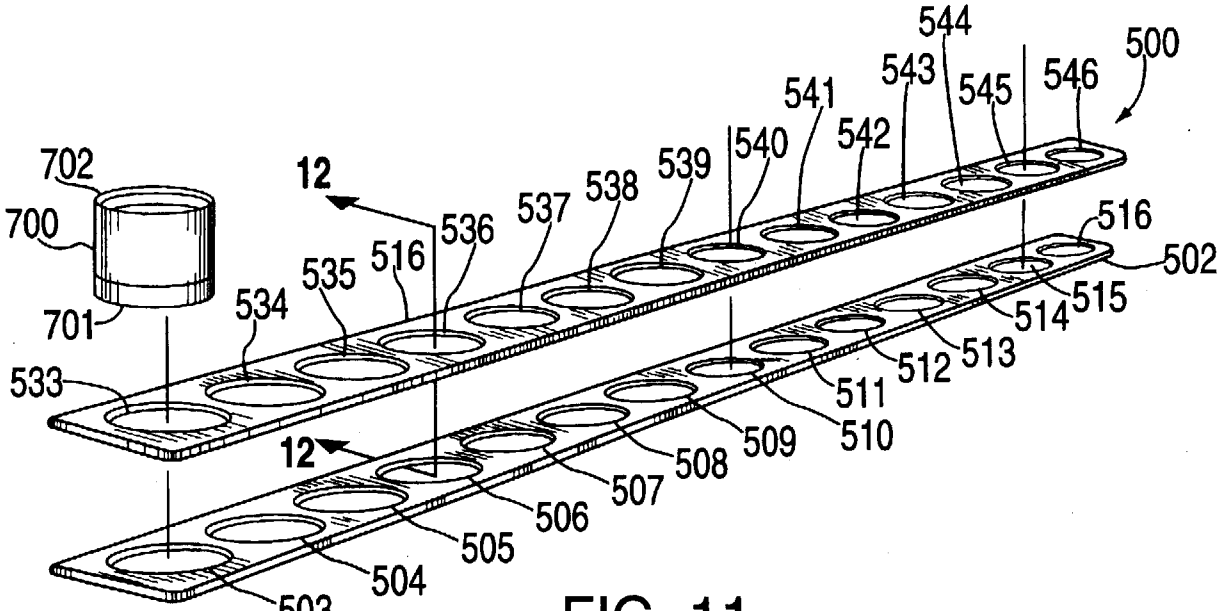
FIG. 11 is an exploded view of a magnetic tool holder and a socket.

Preferably, apertures 303–327, 330–353, 503–515 (FIGS. 11 and 12) include substantially circular apertures designed to hold sockets 402 (FIGS. 1–8), and socket 700 (FIG. 11). The substantially circular apertures comprise diameters that will accommodate most common socket sizes. This range of diameters of the apertures allows for a wide variety of sockets from different manufacturers to be used in connection with the tool systems 200, 300, silhouette page 600, and holder 500, thus decreasing manufacturing cost and increasing utility. Preferably, the system of tool management 200, 300 has a planar array of apertures having at least one row of apertures 303–315 having diameters of descending or ascending diameter to assist in the identification of sockets. Optionally, the center of each aperture is positioned along a line to assist in visually positioning of the respective tool or portion thereof.

In one variant, the apertures are substantially rectangular in shape. The apertures universally accommodate both metric and SAE size shallow sockets having quarter inch drives and have a height of 0.920 inches and a width in the range of 0.479 inches to 0.690 inches. The apertures further universally accommodate both metric and SAE size deep sockets having quarter inch drives and have a height of 2.060 inches and a width in the range of 0.493 inches to 0.690 inches in another variant. In yet a further variant, the apertures universally accommodate both metric and SAE size deep sockets having half inch drives and have a height in the range of 1.4915 inches to 1.8005 inches and a width in the range of 0.7330 inches to 1.0345 inches. It is understood that the various dimensions, e.g. width, height, diameter and the like, of other size drive sockets can also be determined so that apertures are provided that will accommodate various metric and standard sizes, and the various products of different manufacturers. Universal dimensions are determined for various apertures, and used herein. The apertures can also optionally have more than one surface. Bay way of example, the inside surface of the apertures is textured, v-shaped, or has other three dimensional features.

Figure 5:
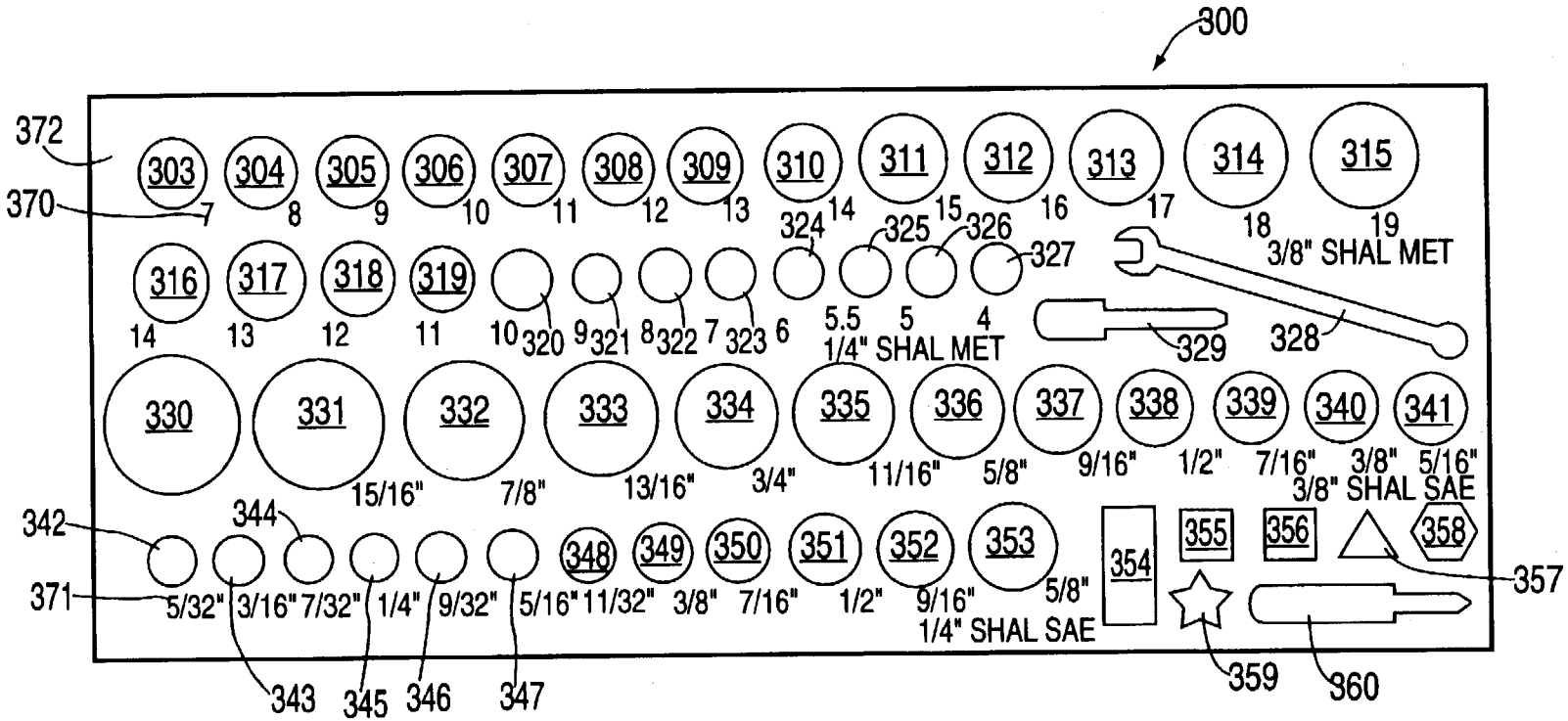
FIG. 5 is a top plan view of a magnetic tool management system having indicia thereon describing tools corresponding to various apertures.
Figure 7:
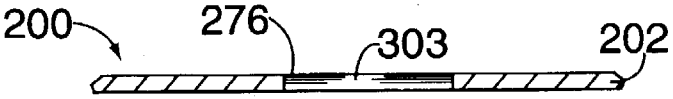
FIG. 7 is a side cross-sectional view of the magnetic tool management system of FIG. 4.

Apertures can also be of any geometric size and shape. Exemplary geometric apertures include rectangular aperture 354, square aperture 355–356, triangular aperture 357, hexagonal aperture 358, star shaped aperture 359, wrench shaped aperture 328, and screw driver shaped apertures 329, 360 (FIG. 5). The apertures are also of a size and shape to accommodate power tools and other hand tools (not shown). In a variant, the inside surface of the aperture is formed so as to cradle a tool or portion thereof.

In one variant, system of tool management 200, 300 does not comprise indicia thereon describing tool(s) corresponding to the apertures associated with each respective system 200, 300. Rather, indicia describing tool(s) corresponding may optionally be located on the tools that correspond to respective apertures. By way of example, socket 700 has indicia thereon describing the socket as a "5/32" socket. Socket 700 is placed in an aperture on system 200 or 300, and the size of the socket is read by a user from socket 700 rather than from indicia on systems 200, 300. In yet a further variant, a surface on which system 200, 300 is placed has indicia thereon corresponding to respective tools visible and readable through respective apertures on system 200, 300, and system 200, 300 have no indicia thereon or only indicia thereon corresponding to a limited number of tools. Further indicia describe the type of engine part, screw, or other type of hardware that an aperture accommodates.

In another variant, system of tool management 200 has optional indicia disposed on magnetically attracting member 202 (FIG. 5) describing the tool corresponding to at least one of the apertures 303–360. The indicia describes the size of a socket 700 that corresponds with the aperture, e.g. aperture 370 for a "7 mm" socket and aperture 371 for a "5/32" socket. Various other types of indicia describing the tools corresponding to the various apertures are also used in the present invention. Exemplary indicia 370, 371 are applied to magnetically attracting members 202, 302 by marking, stamping, labelling, screening, painting and other methods by which indicia are applied.

Figure 3:
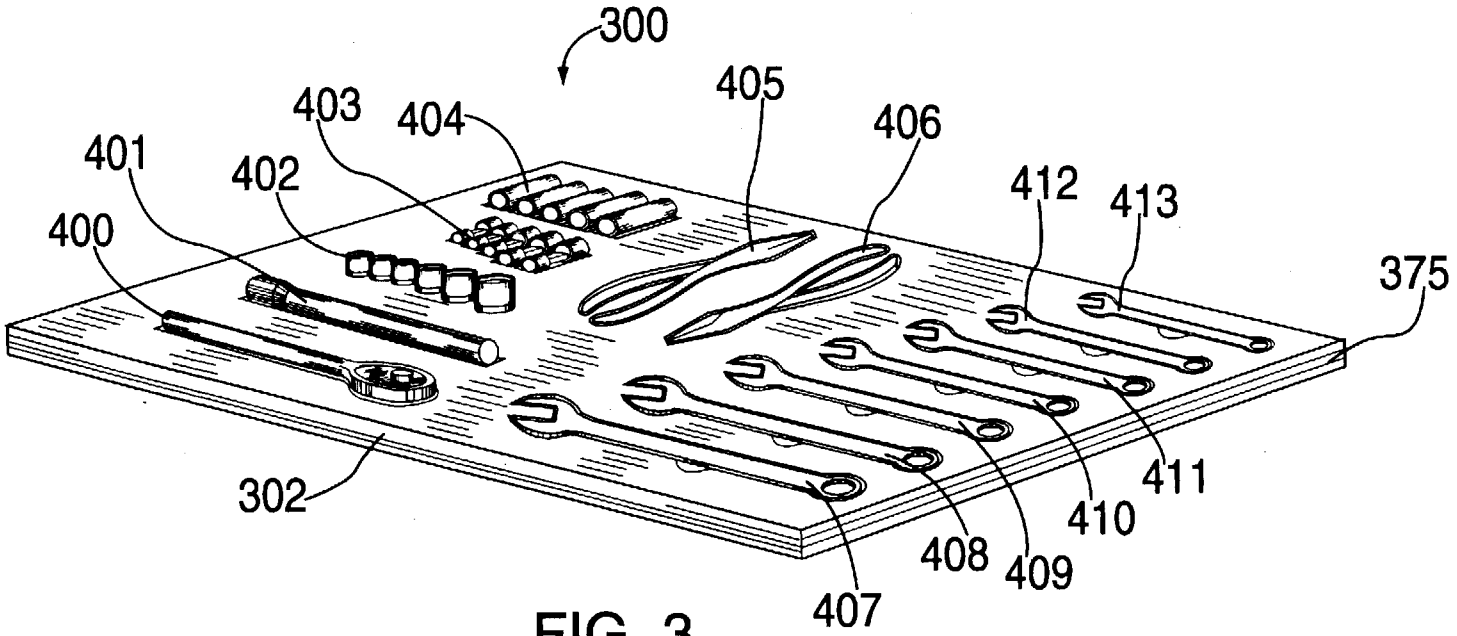
FIG. 3 is a perspective view of a magnetic tool management system having an overlay, and a plurality of tools and portions thereof disposed thereon.
Figure 4:
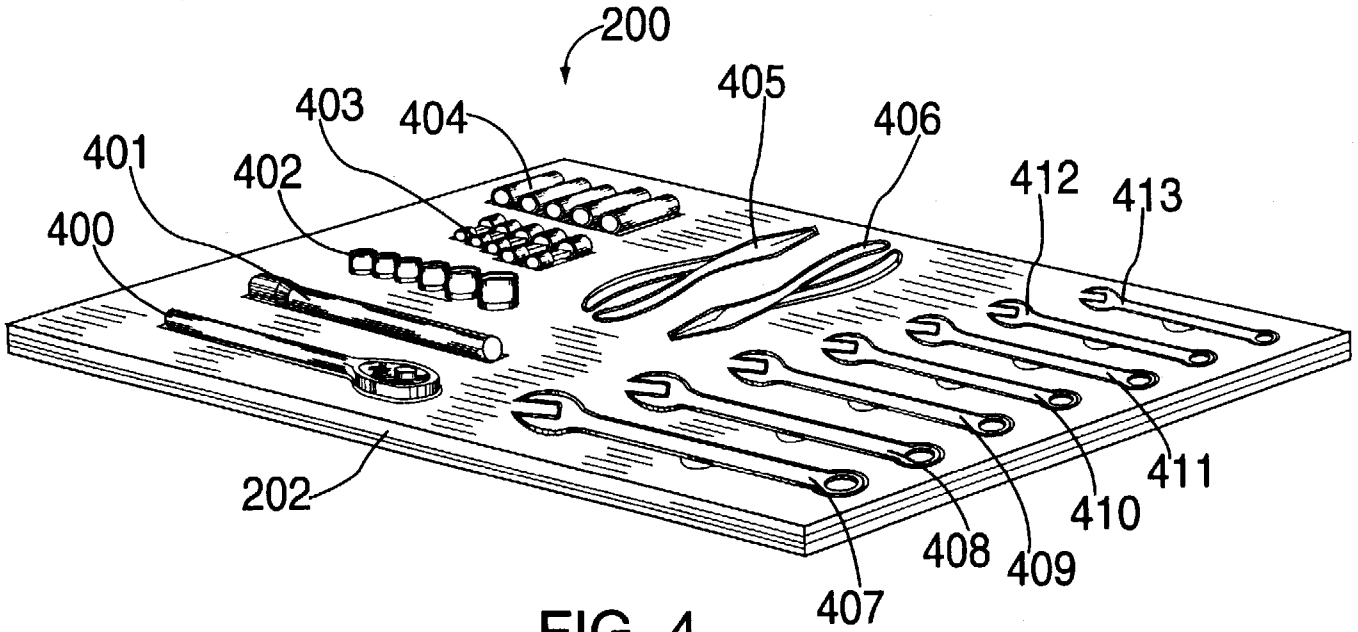
FIG. 4 is a perspective view of a variant of the magnetic tool management system of FIG. 3.
Figure 6:
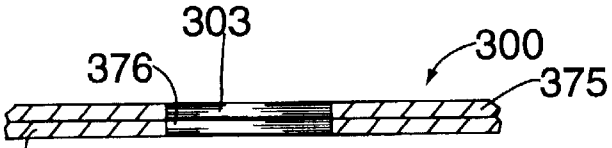
FIG. 6 is a side cross-sectional view of the magnetic tool management system of FIG. 3.

Magnetically attracting member 302 (FIGS. 2, 3, and 6) has an optional overlay 375 (FIGS. 2, 3, and 6). Overlay is generally constructed of a protective material applied to magnetically attracting member 302. In one variant, overlay 302 is a flexible, hydrocarbon resistant coating. Examples of protective hydrocarbon resistant coatings include urethanes, polyurethanes, enamels, latex based coatings, oil based coatings and other polymeric coatings. In one variant, the overlay is a foam overlay used in military type applications. The foam overlay can be used to provide depth for tools protruding above members 202, 302.

Preferably, inside surfaces 276, 376 of apertures 303 (FIGS. 6–7) of magnetically attracting members 202, 302, respectively, are free of overlay. Overlay 375 is resistant to abrasion and also petrochemicals such as gasoline, diesel fuel, oils, grease and the like. In yet another variant, overlay 375 is selected from the group consisting of a laminate, a plastic, a vinyl, a varnish, a lacquer, an acrylic, and the like. Preferably, overlay 375 is applied to member 302, and the like, so as to maximize the contact between the tool resting in a respective aperture and member 302.

Figure 12:
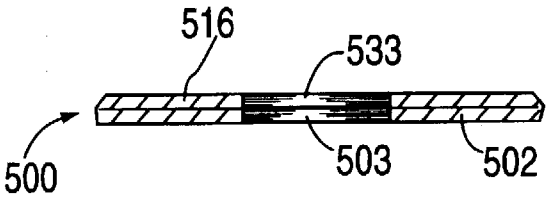
FIG. 12 is side non-exploded cross-sectional view of the magnetic tool holder of FIG. 11 along phantom line 11*a*.
Figure 13:
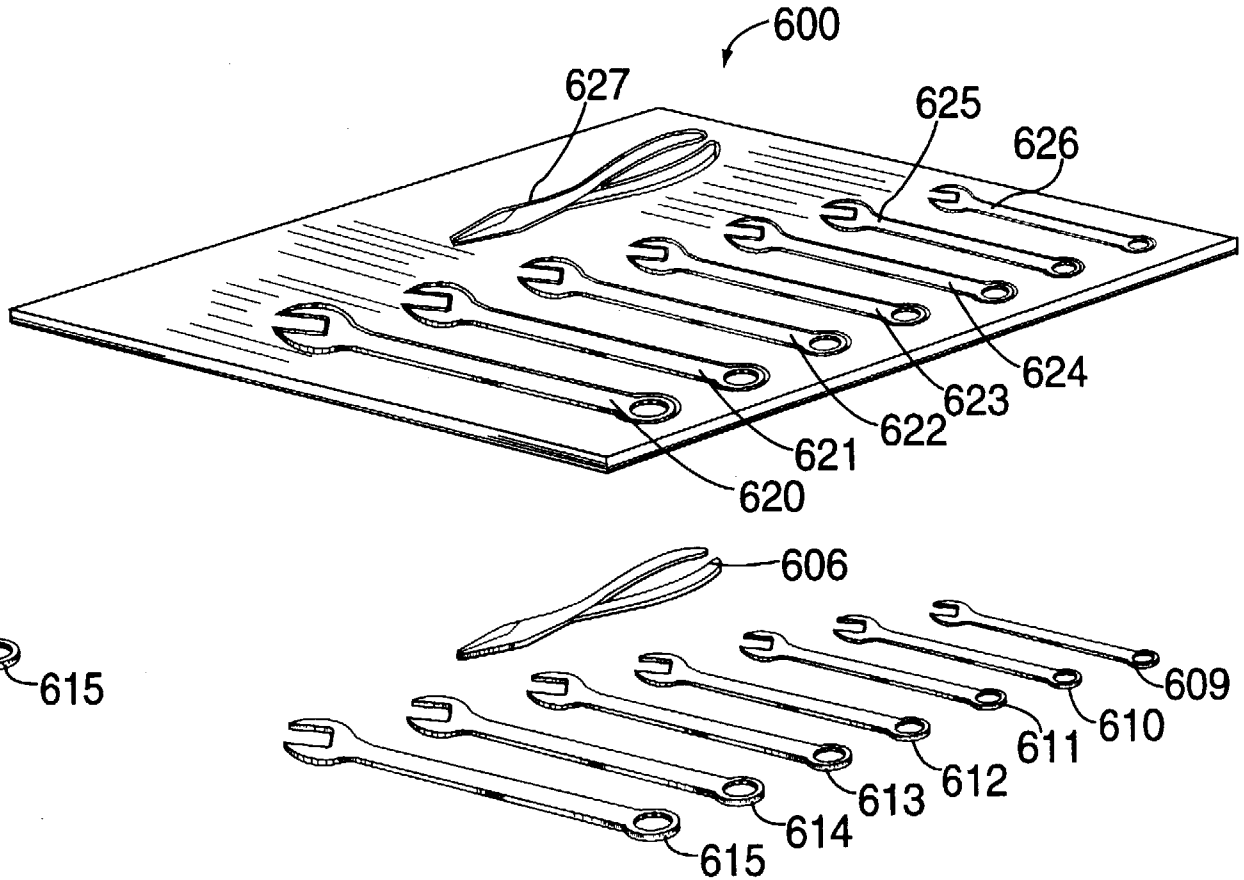
FIG. 13 is an exploded perspective view of a plurality of magnetic tool silhouettes and a magnetic tool silhouette page.
Figure 9:
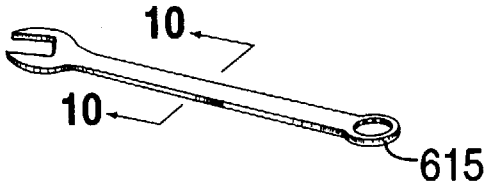
FIG. 9 is a perspective view of a magnetic tool silhouette of FIG. 8.
Figure 10:
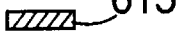
FIG. 10 is a perspective view of the magnetic tool silhouette of FIG. 9 along phantom line 9*a*.

Tool holder 500 comprises a top body member 516 (FIGS. 11 and 12). Top body member 516 is constructed of a metal, wood, plastic, or other suitable material. Preferably, top body member is constructed of a magnetically attracted metal such as steel, and the like. Top body member 516 has a plurality of spaced apart body member apertures 533–546 (FIGS. 11 and 12), analogous to body member apertures 503–516. As previously stated, apertures 503–516, 533–546 are of any suitable geometric shape or size. Body member apertures 503–516, 533–546 are of a size and shape for accommodating at least one surface of a tool that is magnetically attractable to magnetic segment 502. By way of example, the apertures may be of a shape to accommodate socket 700, e.g. aperture 503, and corresponding aperture 533. It will be appreciated that when in use the bottom surface 701 of socket 700 rests on a magnetically attracted surface, e.g. surface 108 of tool box 100 (FIG. 2), and the magnetically attracted surface contacts magnetic segment 502. As surface 701 rests on a magnetically attracted surface it is further appreciated that sockets having a greater length or diameter, or other vertical dimension, can be disposed on tool holder 500 with minimum space. The sockets will protrude from the holder only the length or diameter of the respective socket since there is nothing interposed between the socket and the magnetically attracted surface. Where the tool holder 500 and exemplary socket 700 (FIG. 11) is disposed within tool compartment 102, greater clearance is provided between the edge 151 of compartment 150 and the top 702 of socket 700 since bottom surface 701 rests directly on compartment floor 152. It will be appreciated that sockets, and other tools, of greater height, length, and diameter can be stored in tool box compartments with the present invention. The same features and benefits are also provided with systems 200, and 300.

Tool holder 500 comprises a magnetically attracting member 502 (FIGS. 11 and 12) analogous to members 202, 302. Magnetically attracting member 502 is optionally attached to top member 516 by any suitable means including glues, epoxies, screws, rivets, and the like. It will be appreciated that when member 516 is constructed from steel or material embedded with ferrous particles, magnetic segment 502 will magnetically attract top member 516 and where resting on a magnetically attracted surface, e.g. 108 (FIG. 1), also attract the magnetically attracted surface.

It is also understood that magnetically attracting members 502, 302, and 202 are optionally constructed from a plurality of magnetically attracting segments having apertures thereon. In a variant, where top body member 516 comprises 16 gauge steel, magnetic segment 502 has a thickness of 187 thousandths of an inch. The magnetic segment 502 is ¾ of an inch in thickness in one embodiment. All magnetic segments disclosed herein are a conventional magnet in one variant and a multi-pole magnet in another variant. Compartment 102, and tool box 100 comprise a magnetically conductive material such as low to medium grade carbon steel, other ferrous metal, or material having ferrous metal particles embedded therein.

As illustrated in FIGS. 8–10, and 13, a system of tool management is also provided in which magnetic tool identifiers, e.g. silhouettes 604, 606, 608–615, are also provided. Magnetic tool silhouettes 604, 606, 608–615 are formed on magnetically attracting silhouette sheet 602. Sheet 602 is analogous to magnetically attracting members 202, 302, and 502 and is formed from analogous materials. Sheet 602 has perforations 620–627 corresponding to the outlines of respective tools 609–615, 606. Tools 609–615, 606 are punched out of sheet 602 to free the tools from sheet 602. The respective tools are then placed on a magnetically attracted surface as identifiers. For example, magnetic tool silhouettes 604, 606, 608–611 are placed on respective tool compartments to identify the contents of the compartments of tool box 100 (FIG. 8).

A method of assembling a tool display utilizes magnetic tool management systems 200, 300, and tool holder 500 is disclosed herein. By way of example, a tool display comprises a magnetic tool management systems 200, 300 and at least one tool 700 (FIG. 11), or portion thereof. By way of further example, a tool display includes a tool box 100.

A method of assembling a tool display comprises the steps of providing a magnetic tool management system 200, 300, holder 500 and inserting a tool, e.g. socket 700, into aperture (s) 303 (FIGS. 6 and 7), 503, 533 (FIG. 12) disposed on magnetic tool management systems 200, 300. Accordingly, compared to traditional methods of assembling tool displays utilizing traditional spring clips, time, labor, and cost savings are greatly enhanced. Exemplary tools 700 are inserted into tool systems 200, 300 or tool holder 500 manually and/or mechanically.

Figure 14:
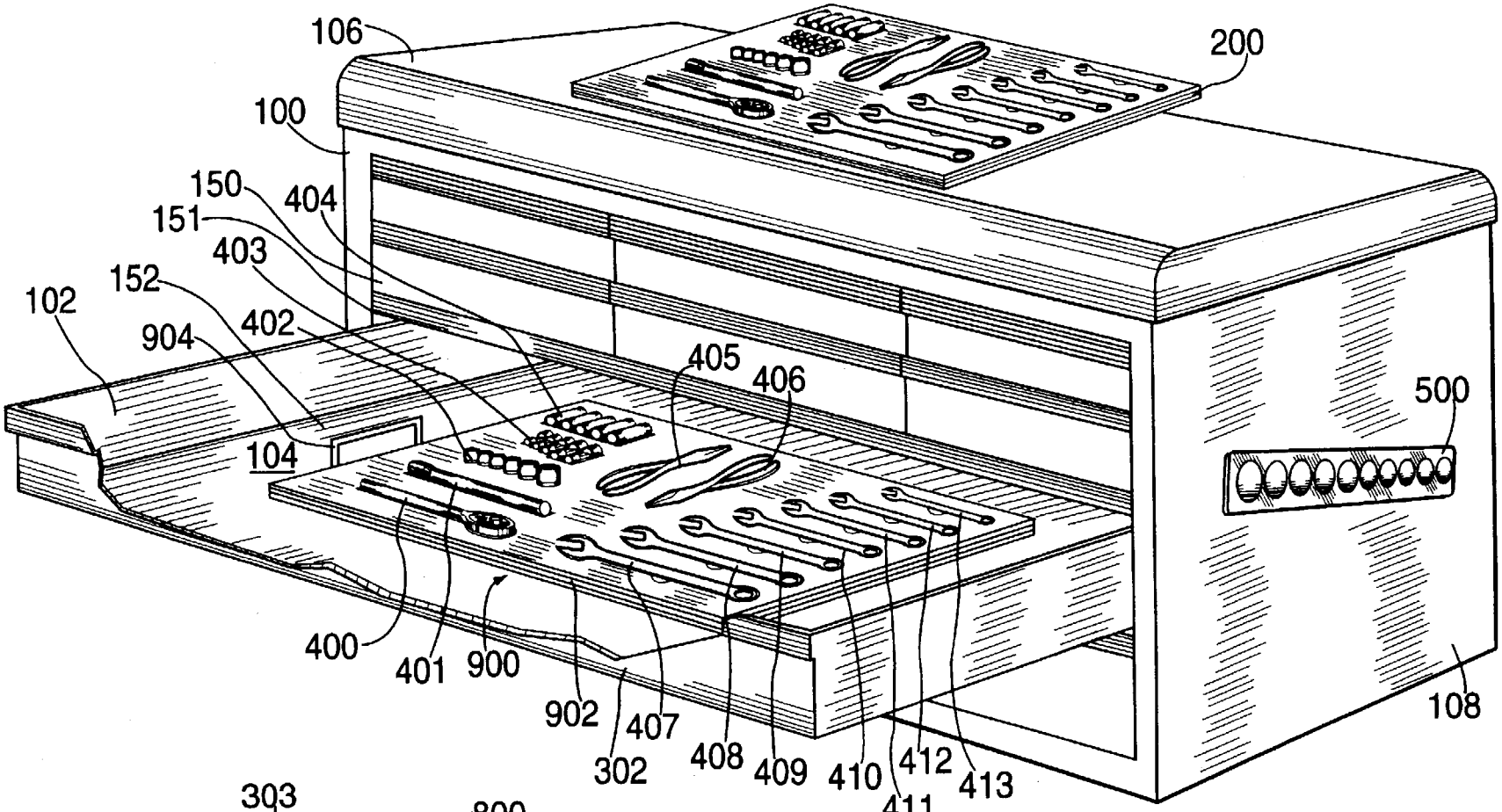
FIG. 14 is a perspective view of a tool box with a magnetic tool management system having a clip board type design disposed within a compartment of the tool box.

As illustrated in FIG. 14, magnetic tool management system 900 has a clip board type design and is disposed within a compartment of the tool box 100. System 900 has member 302 and body member 902 disposed beneath member 302. Body member 902 is constructed of metal, plastic, wood or combination thereof, and is generally planar. Tools 400–413 rest in apertures disposed on member 302 and rest against member 902. System 904 optionally has handle 904 disposed on the system to allow for the easy removal or return of system 900 with tools 400–413 from the tool box 100 compartment. In a variant, member 902 has magnetically attracting properties similar to members 302, 202, and member 302 is non-magnetically attracting and has apertures disposed thereon. It is understood that this clip board type of design facilitates the use of the tools disposed in an entire compartment without necessitating the removal of individual tools to a remote location. Rather, the entire system 900, with tools thereon, is removed from and returned to the compartment of tool box 100. FIG. 3 illustrates handle 545.

While only a few, preferred embodiments of the invention have been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

I claim:

1. A system of tool management and inventory control comprising:

(a) a magnetically attracting material sized and dimensioned to magnetically attract a plurality of tools, said magnetically attracting material having a top surface and a bottom surface and having a plurality of spaced apart apertures extending from said top surface through said magnetically attracting material to said bottom surface, the apertures being a plurality of sizes or shapes for accommodating a plurality of tools, and the apertures organized in a substantially planar array; and, (b) indicia disposed on said magnetically attracting material describing a tool corresponding to at least one of the apertures.

2. The system of tool management of claim 1 in which said tool is a portion of a tool.

3. The system of tool management of claim 1 in which said array comprises an array of substantially circular apertures.

4. The system of tool management of claim 3 in which said substantially circular apertures hold sockets.

5. The system of tool management of claim 1 in which said apertures are substantially rectangular in shape and have widths and heights to universally accommodate both metric and SAE size sockets.

6. The system of tool management of claim 1 in which said planar array comprises at least one row of apertures having diameters of descending diameter.

7. A system of tool management and inventory control comprising:

(a) a magnetically attracting material sized and dimensioned to magnetically attract a plurality of tools, said magnetically attracting material having a top surface and a bottom surface and having a plurality of spaced apart apertures extending from said top surface through said magnetically attracting material to said bottom surface, the apertures being a plurality of sizes or shapes for accommodating a plurality of tools, said apertures organized in a substantially planar array; and, (b) an overlay applied to said magnetically attracting member, said overlay having indicia thereon describing a tool corresponding to at least one of said apertures.

8. The system of tool management of claim 7 in which said tool is a portion of a tool and includes a socket.

9. The system of tool management of claim 7 in which said overlay is a flexible, hydrocarbon resistant coating.

10. The system of tool management of claim 7 in which said overlay comprises a polymeric coating.

11. The system of tool management of claim 7 in which said overlay comprises a coating selected from the group consisting of enamels, vinyls, and lacquers.

12. The system of tool management of claim 7 in which an inside surface of said apertures is free of overlay.

13. The system of tool management of claim 7 in which said overlay is a laminate.

14. The system of tool management of claim 7 in which said tool is a portion of a tool.

15. The system of tool management of claim 7 in which said array comprises an array of substantially circular apertures.

16. The system of tool management of claim 7 further comprising a plurality of sockets disposed within said substantially circular apertures.

17. The system of tool management of claim 7 in which said apertures are substantially rectangular in shape and accommodate both metric and SAE size sockets having a width selected from the group of widths in the range of about 0.479 inches to about 0.690 inches, in the range of about 0.493 inches to about 0.690 inches, and in the range of 0.7330 inches to 1.0345 inches, whereby said system of tool management universally accommodates a wide variety of sockets.

18. The system of tool management of claim 7 in which said planar array comprises at least one column of apertures having diameters of descending diameter.

19. A tool box having at least one compartment in which the improvement comprises a system of tool management, said system of tool management comprising a magnetically attracting material, said sheet of magnetically attracting material having a top surface and a bottom surface and having a plurality of spaced apart apertures extending from said top surface through said magnetically attracting material to said bottom surface, and the apertures being a plurality of sizes or shapes for accommodating a plurality of tools, and said apertures organized in a substantially planar array; and an overlay applied to said magnetically attracting member, said overlay having indicia thereon describing at least one tool corresponding to said apertures.

20. The tool box of claim 19 in which said tool is a portion of a tool such as a socket and in which said tool box has a plurality of accessible compartments.

21. A magnetic inventory control system for the storage of magnetically attracted components comprising:

a) a non-foil, magnetically attracting material having a plurality of first apertures disposed thereon in which the first apertures accommodate magnetically attracted components; and, b) a body member having second apertures corresponding to at least one of said first apertures, whereby increased holding power is provided by focusing lines of flux between contact points of said magnetically attracted components and said magnetic inventory control system.

22. The system of tool management of claim 21 in which the magnetically attracted components are selected from the group consisting of tools, portions of tools, metallic parts, bolts, nuts, screws, hardware, engine parts, and surgical instruments.

23. A magnetic tool inventory control system for identifying contents of a tool storage device comprising a sheet of magnetically attracting material having a plurality of magnetic tool identifiers disposed thereon, said magnetic tool identifiers in the shape of an outline of a tool and removeably connected to said sheet for placement on a magnetically attracted surface to visually identify the contents of the tool storage device or portion thereof, said fleet of magnetically attracting material having a top surface and a bottom surface and having a plurality of spaced apart apertures extending from said top surface through said magnetically attracting material to said bottom surface after removal of said magnetic tool identifiers from said magnetically attracting material, and the apertures being a plurality of sizes or shapes and in said outline of said magnetic tool identifiers, whereby said magnetic tool identifiers readily identify the contents of said tool storage device after removal of said magnetic tool identifiers from said sheet of magnetically attracting material and placement of said magnetic tool identifiers on said tool storage device.

24. A system of tool management comprising a substantially planar magnetically attracting material having a top surface and a bottom surface and having a plurality of spaced apart apertures extending from said top surface through said magnetically attracting material to said bottom surface, and in which the plurality of apertures are organized in a substantially planar array and dimensioned to hold a family of tools or portions thereof.

25. The system of tool management of claim 24 in which the apertures are configured to accept a range of portions of tools of varying sizes.

26. The system of tool management of claim 24 in which the apertures are configured to accept sockets, said apertures arranged in ascending or descending order according to the outside diameter of said sockets.

27. A system of tool management comprising:

a magnetically attracting material having a top surface and a bottom surface and having a plurality of spaced apart apertures extending from said top surface through said magnetically attracting material to said bottom surface, and the apertures being a plurality of sizes or shapes for accommodating a plurality of tools, and in which the apertures are organized in a substantially planar array;

a substantially planar lower body member connected to the magnetically attracting member that retains the component in the system of tool management; and, a handle disposed on the system to assist in the transportation of the system from one location to another remote location.

28. The system of claim 27 in which the lower body member is a metal.

* * * * *